United States Patent [19]

Matthews

[11] 4,237,636

[45] Dec. 9, 1980

[54] VERTICAL GRAPHIC PANEL FRAME SYSTEM

[75] Inventor: James P. Matthews, Atlanta, Ga.

[73] Assignee: Miller - Zell, Inc., Atlanta, Ga.

[21] Appl. No.: 45,920

[22] Filed: Jun. 6, 1979

Related U.S. Application Data

[63] Continuation of Ser. No. 920,194, Jun. 29, 1978, abandoned.

[51] Int. Cl.[3] ..... G09F 7/18

[52] U.S. Cl. ..... 40/606; 40/155; 40/617

[58] Field of Search ..... 40/606, 607, 610, 605, 40/617, 152.1, 155, 156, 154, 152; 248/441 B, 441 C, 208, 529, 159, 165, 219.2

[56] References Cited

U.S. PATENT DOCUMENTS

| | | | |
|---|---|---|---|
| 738,443 | 9/1903 | Henshaw | 40/152 |
| 1,361,911 | 12/1920 | Schwesinger | 40/607 |
| 1,968,209 | 7/1934 | Irby | 40/606 |
| 2,345,935 | 4/1944 | Bishop | 40/606 |
| 2,373,778 | 4/1945 | Quinby | 40/605 |
| 2,559,106 | 7/1951 | Bishop | 40/606 |
| 3,969,838 | 7/1976 | Moore | 40/606 |
| 4,068,398 | 1/1978 | Parisi | 40/607 |

FOREIGN PATENT DOCUMENTS

| | | | |
|---|---|---|---|
| 2716399 | 7/1978 | Fed. Rep. of Germany | 40/607 |

*Primary Examiner*—John F. Pitrelli

*Attorney, Agent, or Firm*—Cushman, Darby & Cushman

[57] ABSTRACT

A vertical graphic frame system having two vertical support posts with anchor brackets and fasteners and a single two-panel frame which swingably rests in a "V"-shaped groove on top of the vertical support posts. The frame hangs freely from two suspension points above the frame's center gravity which causes the system to be self-adjusting into a plum position. Each of the support posts consists of two "U"-shaped channel members which face and overlap each other. By adjusting the overlap of the U-channels, the posts may be widened or narrowed to permit them to be affixed to base structures such as gondola fixture partitions, having a range of widths.

8 Claims, 4 Drawing Figures

VERTICAL GRAPHIC PANEL FRAME SYSTEM

This is a continuation, of application Ser. No. 920,194 filed June 29, 1978, now abandoned.

BACKGROUND AND OBJECTIVES OF THE INVENTION

This invention relates to vertical graphic media frame systems, particularly useful for "in store" displays. Both outdoor and indoor panel frame systems having a frame which is removable from a support structure are known in the prior art. However, these devices are either complex in construction or lacking in sturdiness. Such devices are not easily fastened to more than one partition width when used in an "in-store" setting. These deficiencies are corrected by the present invention.

The frame system described herein is preferably constructed from a sheet metal such as steel, and consists primarily of five shapes of sheet steel, two of which are in a heavier gauge than the other three. Except for the fasteners, the metal need only be bent into "U" and "J" shapes and punched with round holes and slots. The pieces are easily assembled into two posts and a dual panel frame. Each post is assembled from two U-shaped channels with a beveled cut at one end of the "U" which are overlapped with each other to form a V-shaped edge on top of the posts from which the panel frame may be suspended by suspension hooks. By adjusting the degree of overlap of the U-channels of each post the post widths may be varied to suit the width of the partition on which it is secured, the vertex of the "V" at the top of the post always being centered. The frame primarily consists of three pairs of J-shaped channels which form three sides of a dual panel frame. Hooks are sandwiched between the J-channel side members at their top for suspending the panel on the posts. A removable rectangular cap section may be placed on the fourth side of the panel frame to complete the enclosure of the frame.

BRIEF DESCRIPTION OF FIGURES IN DRAWING

In the drawing

DETAILED DESCRIPTION OF THE PREFERRED EMBODIMENT

Figure 1:
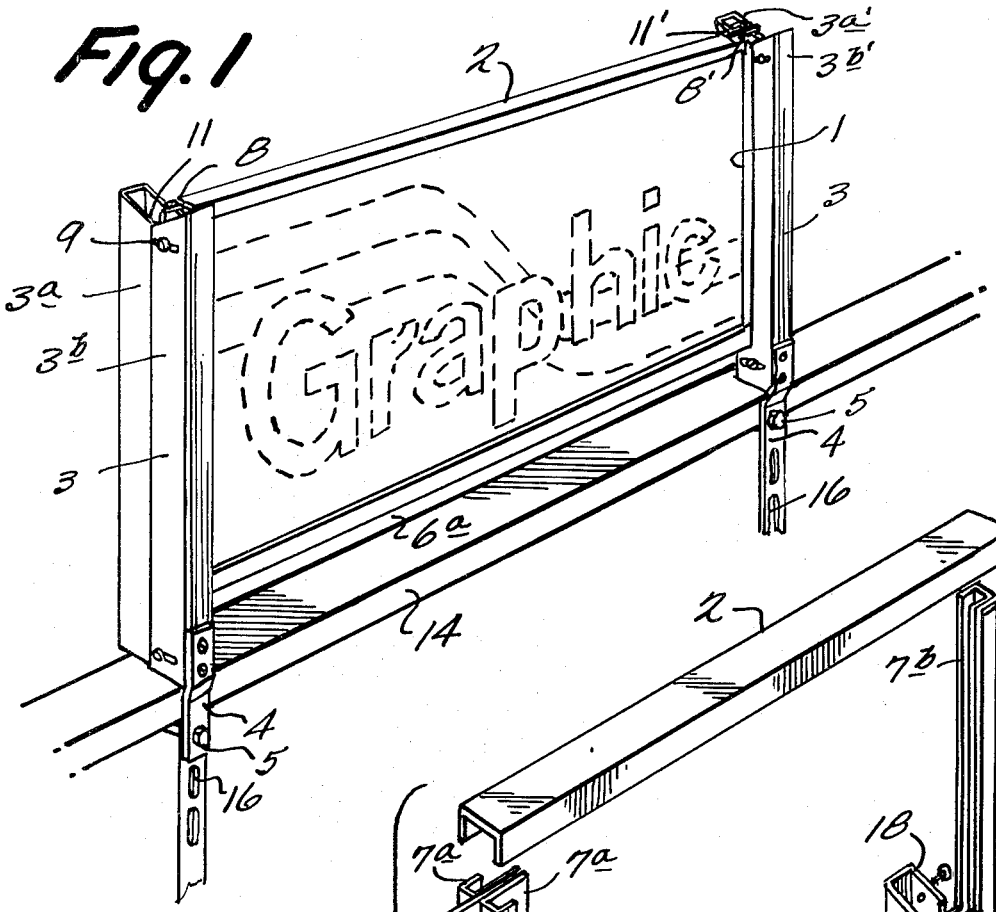
FIG. 1 is a perspective view of the system installed in a typical display station atop a gondola fixture partition.
Figure 2:
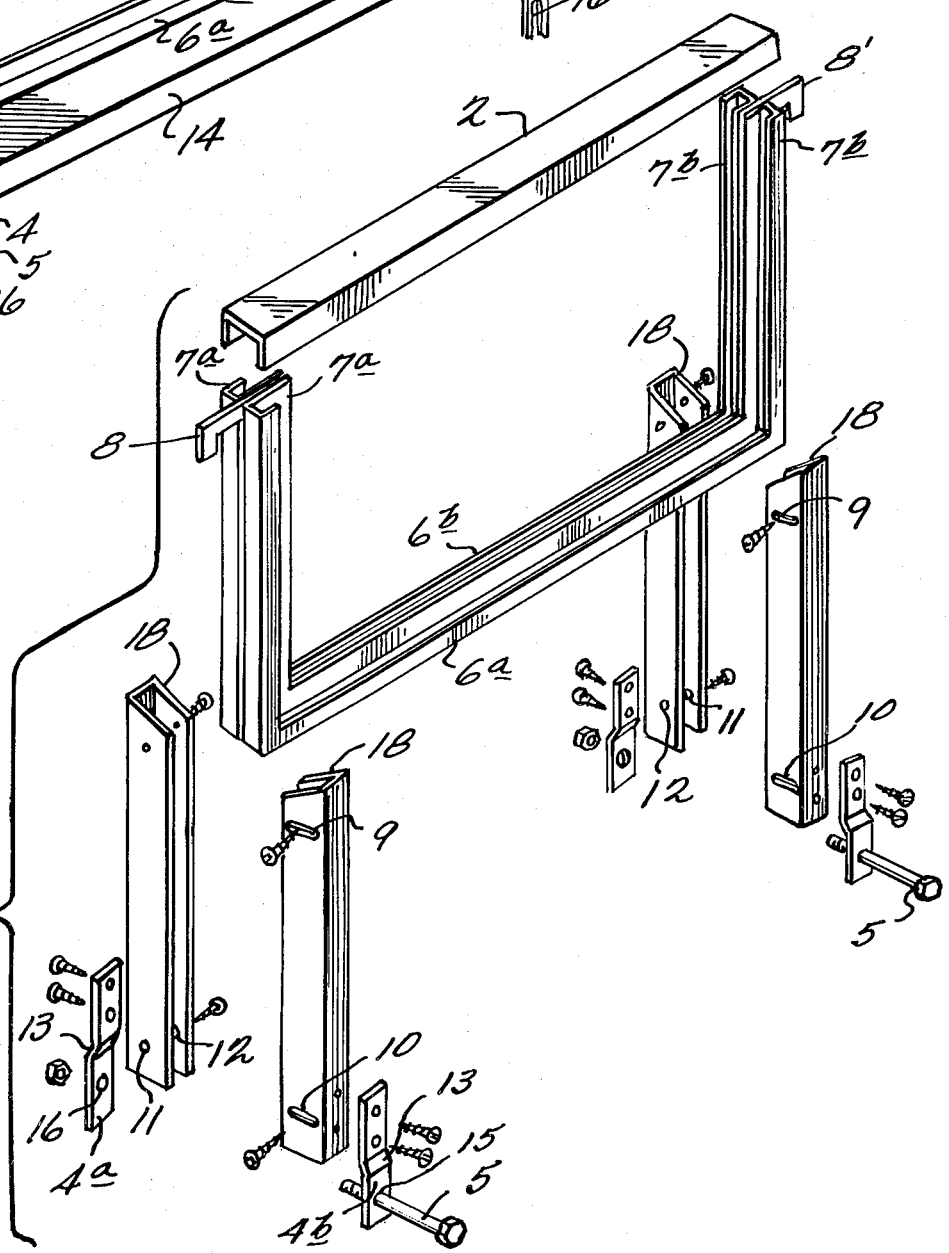
FIG. 2 is a perspective exploded view of the elements of the system.
Figure 4:
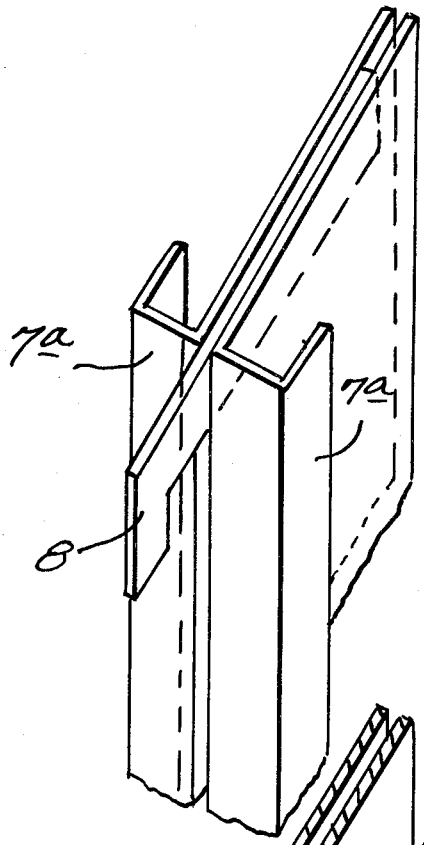
FIG. 4 is an enlarged and broken away perspective view of a suspension hook portion of the panel frame.
Figure 3:
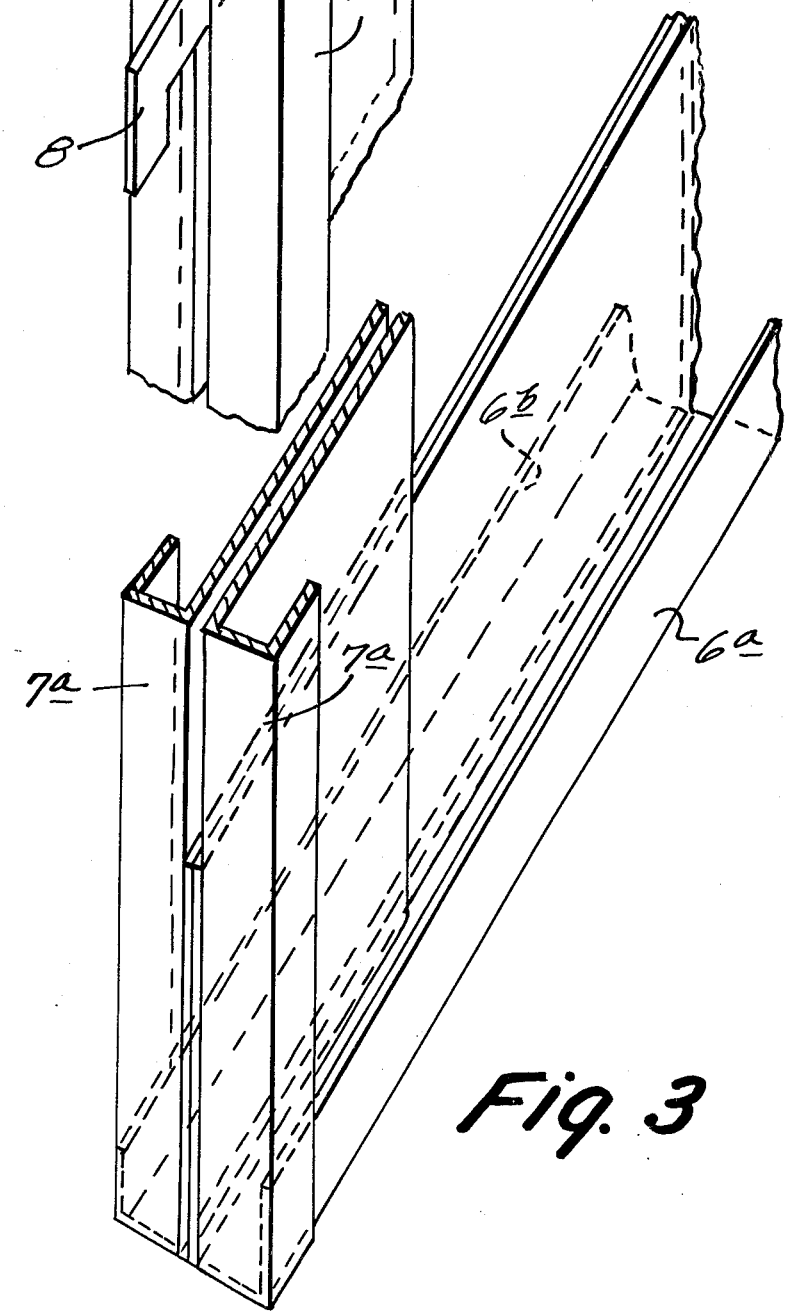
FIG. 3 is an enlarged and broken away detailed perspective view of a corner of the panel frame.

The display system illustrated in the drawing consists of a single dual panel frame 1, a frame cap section 2 and two vertical support posts 3 which are provided with anchor brakets 4 and fasteners 5. The panel frame 1 is primarily constructed of six sections of one configuration of fabricated sheet steel "J" channel. Two "J" channels *6a* and *6b* are of one length corresponding to the length of frame 1, and 4 "J" channels *7a*, *7a'*, *7b* and *7b'* are of another length corresponding to the height of frame 1. "J" channel pairs *6a–6b*, *7a–7b* and *7a'–7b'* are each fixed back-to-back with the long legs of the "J" against each other and the short legs opposite each other. The corners of panel frame 1 are formed by overlapping and sandwiching pair *6a–6b* between and at one end of *7a–7b* and *7a'–7b'* at a 90° angle to form three quarters of the total enclosure of the frame 1. Suspension hooks 8–8', fabricated from a heavier gauge sheet steel, are sandwiched between the halves of each "J" channel pair *7a–7b* and *7a'–7b'* at the ends opposite the intersection of "J" channels 7 and "J" channels 6, with the claw of the hook facing opposite the enclosure of the overall frame 1, i.e., downwardly. Assembly of all of the elements of the frame 1 may be achieved through resistance welding. A single panel frame may be achieved by eliminating one of each pair of "J" channels, leaving two sections of one length and one sectjion of the other, and the two suspension hooks, the construction being essentially the same as the duel panel frame described above.

In use, one or two display panels 17 may be inserted downward through the grooves of the "J" channels 7 until the bottom(s) of the panel(s) rests in "J" channel 6. To complete the enclosure of the frame, once the panels are inserted, a cap section 2 constructed from fabricated sheet steel "U" channel, having a length approximately equal to that of "J" channels 6 and a width approximately equal to the width of the bottom back-to-back "J" channels *6a–6b* is inserted "U" downward over the panel tops between the small sides of the "J" channels 7. The cap section 2 may be constructed of the same gauge steel as the "J" channels.

Each of the post halves *3a*, *3b*, *3a'*, and *3b'* are fabricated from steel sheets of identical lengths and configuration into identical "U" channels having a beveled edge 18 at one end of the "U" which is directed so that the edges defining the top of the "U" is shorter than the edges forming the bottom of the "U" and having various slotted and rounded holes for assembly as described below. Each of the 4 "U" channel post halves *3a–3d* has a horizontal slot 9 near the top and a horizontal slot 10 near the bottom of one of the two opposing sides of the "U" channel post halves and round holes 11 and 12 on the opposite side of the "U" channel directly across from the end of each slot nearest the top of the "U". When two "U" channels are vertically arranged with the beveled edges 18 at the top and then overlapped to form a rectangular post with the angular edges forming a "V" in which the vertex is precisely along the surface center line of the post, these vertices 11, 11' provide a nesting point for the suspension of the panel frame 1 by its suspension hooks 8 and 8'. Since the overlapping "U" channels 3 which form the suspension post are identical in construction, the corresponding round holes 9 and 10 and slots 11 and 12 will overlap and two sheet metal screws or a combination of machine screws, hex nuts and washers can be used to set a desired post width. Once a post is assembled, identical anchor brackets *4a* and *4b* are attached to the base of each post with either sheet metal screws or a combination of machine screws, hex nuts and washers. The brackets *4a* and *4b* are of a heavier gauge sheet steel and are punched with an offset 13 to locate the correct position for alignment and assembly of the post 3. The fully assemblied post 3 can then be stationed atop a typical partition 14 at a precise distance apart to allow clearance and integral seating of the panel frame 1. To fasten the brackets 4 to the partition, a large hex bolt, hex nut, and washer combination, 5 is inserted through slotted hole 15 in one bracket and through an existing hole or pre-drilled hole in the partition, and through the slotted hole 16 in the other bracket. The slotted holes are provided to allow some adjustment of the posts height relative to the partition before tightening.

Several posts can be aligned along a partition to form a series of panel frames where each post supports one side of two panel frames making a link in the series.

What is claimed is:

1. A panel frame system comprising:

(a) an upright post comprising at least one pair of upright members each said member having a downwardly and inwardly beveled upper end, said members being movable one within the other to provide a composite "V"-shaped edge of adjustable width; and (b) a panel frame having a hook which rests in said "V"-shaped edge.

2. The panel frame system described in claim 1, wherein at least one of said upright members comprises an approximately "U"-shaped channel, the other of said upright members being slidable within said approximately "U"-shaped channel to adjust the width of said post.

3. The panel frame system described in claim 2, wherein both of said upright members are approximately "U"-shaped channels, of approximately identical shape and dimensions.

4. The panel frame system described in claim 3, further comprising means for securing said posts to the top of a partition, said means being adjustable to a range of partition widths.

5. The panel frame system described in claim 4, wherein said securing means comprises at least two brackets and at least one bolt.

6. The panel frame system described in claim 1, wherein said sheet material comprises steel.

7. The panel frame system described in claim 3, wherein said panel frame comprises three approximately "J"-shaped channel members.

8. The panel frame system described in claim 3, wherein said panel frame comprises three pairs of approximately identical approximately "J"-shaped channel members.

* * * * *